US008146582B2

(12) United States Patent
Lee et al.

(10) Patent No.: US 8,146,582 B2
(45) Date of Patent: Apr. 3, 2012

(54) BURNER SYSTEM AND HEATING COOKING APPLIANCE HAVING THE SAME

(75) Inventors: Dae-Rae Lee, Gimgae-si (KR); Jung-Wan Ryu, Changwon-si (KR); Dae-Bong Yang, Jinhae-si (KR); Sang-Min Lyu, Changwon-si (KR); Yong-Ki Jeong, Busan (KR); Young-Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 166 days.

(21) Appl. No.: 12/449,106

(22) PCT Filed: Nov. 27, 2007

(86) PCT No.: PCT/KR2007/006042

§ 371 (c)(1),
(2), (4) Date: Dec. 2, 2009

(87) PCT Pub. No.: WO2008/091058

PCT Pub. Date: Jul. 31, 2008

(65) Prior Publication Data

US 2010/0071682 A1 Mar. 25, 2010

(30) Foreign Application Priority Data

Jan. 23, 2007 (KR) ..... 10-2007-0007191

(51) Int. Cl.
*F24C 3/08* (2006.01)

(52) U.S. Cl. ..... 126/39 E; 126/39 N; 126/39 K; 431/354

(58) Field of Classification Search ..... 126/39 E, 126/39 N, 39 K; 431/354
See application file for complete search history.

(56) References Cited

U.S. PATENT DOCUMENTS

| | | | | |
|---|---|---|---|---|
| 5,176,512 | A | 1/1993 | Evens | |
| 5,816,235 | A * | 10/1998 | Kim et al. | 126/39 H |
| 5,873,713 | A | 2/1999 | Osterhues | |
| 6,253,759 | B1 | 7/2001 | Giebel et al. | |
| 2004/0195399 | A1 * | 10/2004 | Molla | 239/594 |

FOREIGN PATENT DOCUMENTS

| | | | |
|---|---|---|---|
| JP | 2003-065507 | A | 3/2003 |
| KR | 10-1999-0001979 | A | 1/1999 |

* cited by examiner

*Primary Examiner* — Alfred Basichas
(74) *Attorney, Agent, or Firm* — McKenna Long & Aldridge LLP

(57) ABSTRACT

Provided are a burner system and a heating and cooking appliance having the same. The burner system includes a burner pot, and a mixing tube unit. The burner pot provides a space where a gas and air mix and burn, and the mixing tube unit is integrally formed with the burner pot to guide the gas and the air to the burner pot. The burner pot and the mixing tube unit include a plurality of members coupled vertically and forming an appearance.

18 Claims, 4 Drawing Sheets

[Fig. 1]
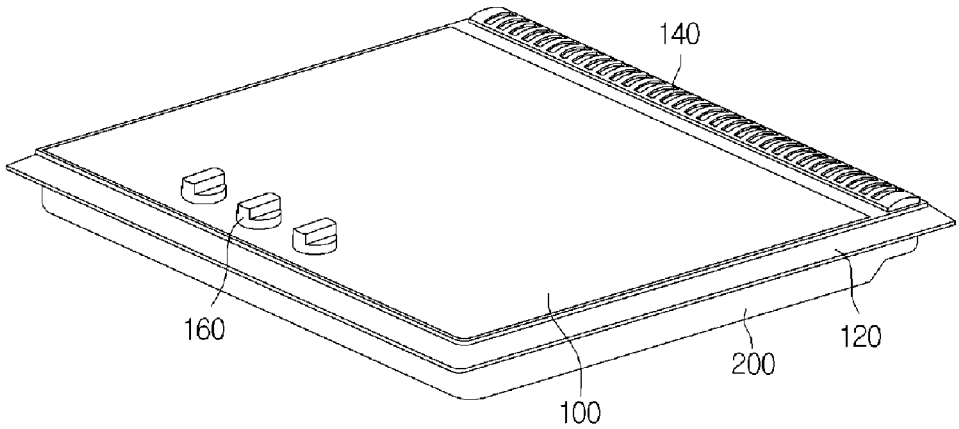
[Fig. 2]
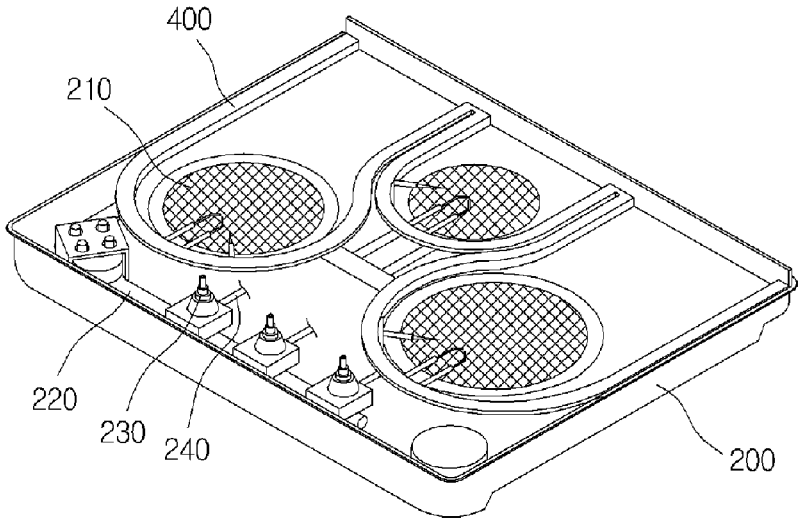

[Fig. 3]
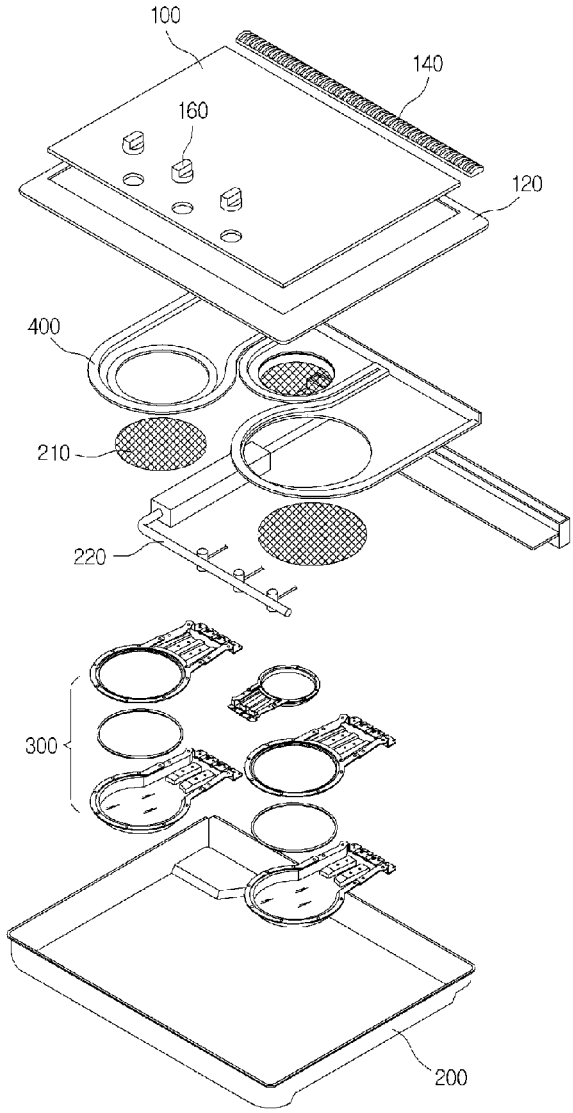
[Fig. 4]
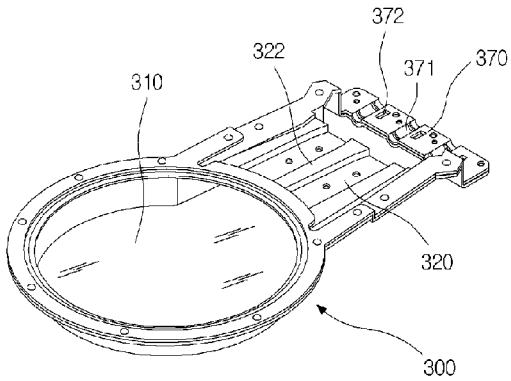

[Fig. 5]
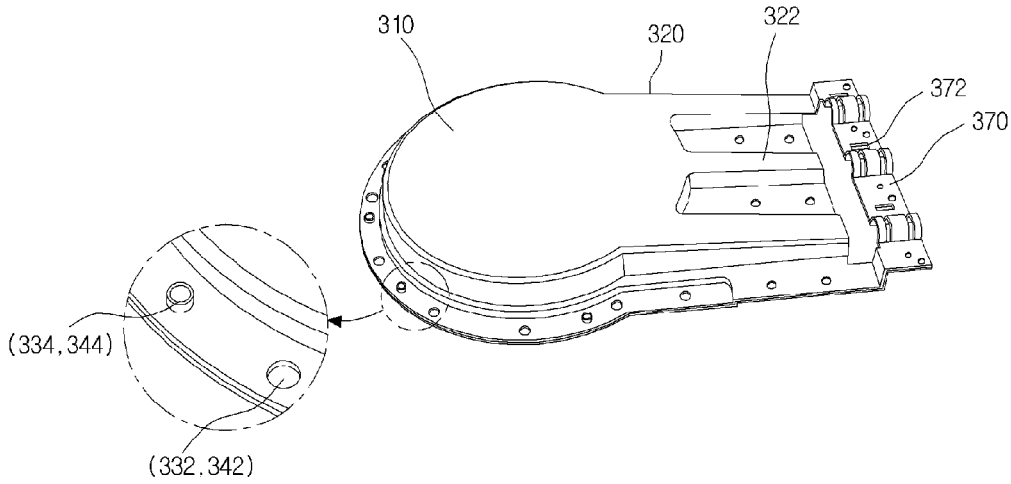
[Fig. 6]
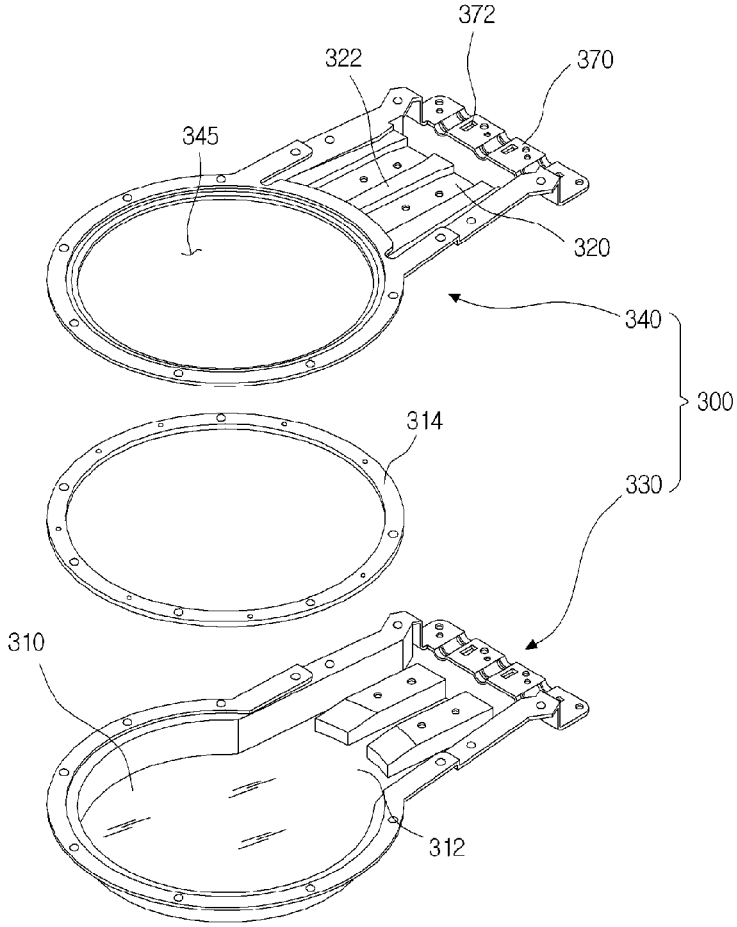

[Fig. 7]
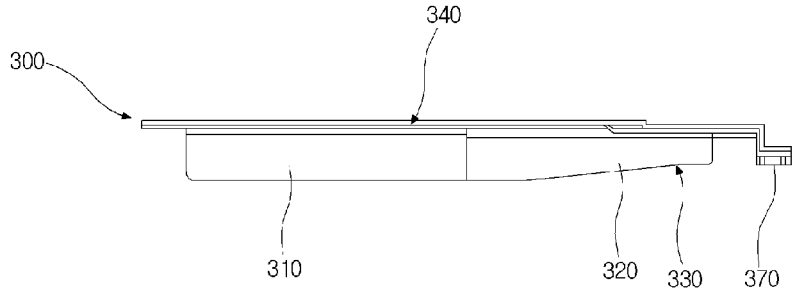
[Fig. 8]
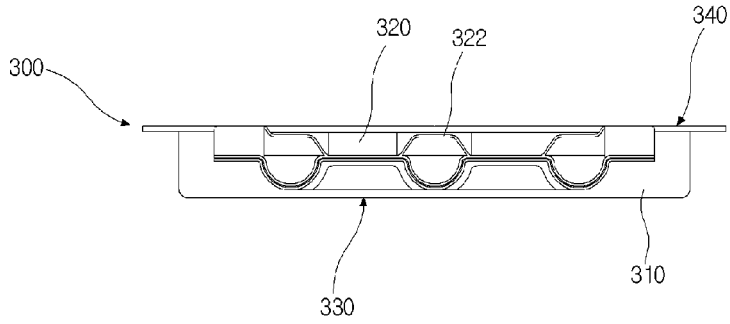
[Fig. 9]
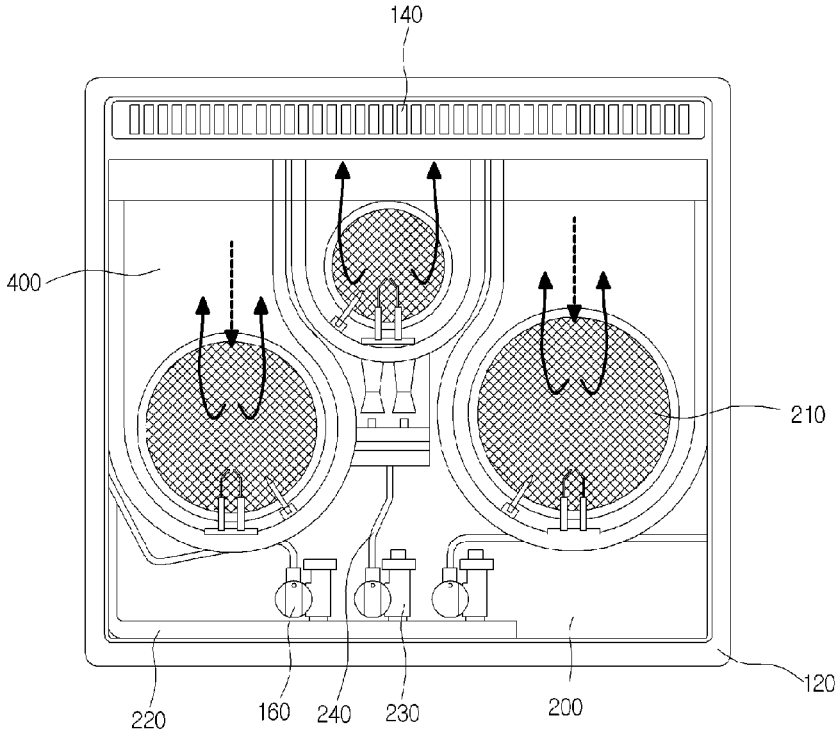

BURNER SYSTEM AND HEATING COOKING APPLIANCE HAVING THE SAME

This application is a National Stage Entry of International Application No. PCT/KR2007/006042, filed Nov. 27, 2007, and claims the benefit of Korean Application No. 10-2007-0007191, filed on Jan. 23, 2007, which is hereby incorporated by reference for all purposes as if fully set forth herein.

TECHNICAL FIELD

The present embodiments relate to a burner system and a heating cooking appliance having the same.

BACKGROUND ART

A heating cooking appliance is an apparatus for heating and cooking food. Particularly, the present disclosure relates to a gas cooktop for applying heat generated in a gas combustion method to food to cook the food using the generated heat. The cooktop, which is an apparatus also called a hot plate or a hob, is now widely used.

The heating cooking appliance uses a burner system to burn gas and heat a plate, which cooks food disposed thereon.

However, a related art heating cooking apparatus only performs a function of cooking food using high heat, and does not have a function for keeping food warm. A warming drawer for storing food warm is provided to the lower portion of an oven, but this structure reduces convenience in using the heating cooking appliance of the present disclosure.

DISCLOSURE OF INVENTION

Technical Problem

Provided are a burner system and a heating and cooking appliance having the same.

Technical Solution

In one embodiment, a heating cooking appliance includes: a case; a plate for covering an upper side of the case; a burner system provided inside the case; and a burner frame provided above the burner system to form an exhaust passage for a combustion gas generated from the burner system, the burner system including: a burner base for providing both a partial surface of a burner pot providing a space where a gas and air uniformly mix, and a partial surface of a mixing tube unit for guiding flowing of the gas and the air to the burner pot; and a burner cover coupled to the burner base to provide other partial surface of the mixing tube unit.

In another embodiment, a burner system of a heating cooking appliance includes: a burner pot for providing a space where a gas and air mix and burn; and a mixing tube unit integrally formed with the burner pot to guide the gas and the air to the burner pot, the burner pot and the mixing tube unit having an appearance formed by a plurality of members coupled vertically.

Advantageous Effects

According to an embodiment, since the burner system is completed through coupling between the burner case and the burner cover, the height and the thickness of the burner system are reduced.

Also, because the thickness of the burner system is reduced, a wide combustion space can be secured, so that heating capacity increases.

BRIEF DESCRIPTION OF THE DRAWINGS

FIG. 1 is a perspective view of a heating cooking appliance according to an embodiment.

FIG. 2 is a perspective view of the heating cooking appliance from which a ceramic plate has been removed.

FIG. 3 is an exploded perspective view of the heating cooking appliance.

FIG. 4 is a perspective view of a burner system according to an embodiment.

FIG. 5 is a perspective view of a lower portion of the burner system.

FIG. 6 is an exploded perspective view of the burner system.

FIG. 7 is a side view of the burner system.

FIG. 8 is a rear side view of the burner system.

FIG. 9 is a plan view illustrating an inlet path and an outlet path of fluid generated from the inside of a heating cooking appliance according to an embodiment.

MODE FOR THE INVENTION

FIG. 1 is a perspective view of a heating cooking appliance according to an embodiment, FIG. 2 is a perspective view of the heating cooking appliance from which a ceramic plate has been removed, and FIG. 3 is an exploded perspective view of the heating cooking appliance.

Referring to FIGS. 1 to 3, the heating cooking appliance includes a case 200 forming an outer shape of the lower portion of the heating cooking appliance and having an open upper side, a ceramic plate 100 covering the upper side of the case 200, and a top frame 120 covering the edge of the ceramic plate 100.

Also, the heating cooking appliance includes an exhaust grill 140 formed at the rear portion of the ceramic plate 100 and through which a combustion gas is exhausted, and manipulation switches 160 formed on the front of the ceramic plate 100 to control on/off of the combustion of the gas. The positions and shapes of the exhaust grill 140 and the manipulation switches 160 can be changed in various specific structures and shapes, and an exhaust portion through which the combustion gas is exhausted and a switch portion for controlling on/off of the combustion of the gas should be provided, of course.

In detail, the ceramic plate 100 is formed in a quadrangular plate shape having a predetermined thickness. A container containing food is disposed on the ceramic plate 100 and heated by radiation heat and conduction heat generated by combustion of a gas, so that the food is cooked by the heat.

The inner structure of the heating cooking appliance will be described with reference to FIGS. 2 and 3.

Three burner systems 300 where a gas and air are sufficiently mixed and the gas uniformly burns are provided in the inner spaces formed by the ceramic plate 100 and the case 200.

Two relatively large burner systems 300 are disposed in both sides inside the case 200, and a small burner system 300 is disposed between the two burner systems 300. Therefore, a container suited for heating capacity of the burner system 300 is disposed on the ceramic plate 100 to allow the container to be heated.

Also, a mixed gas is supplied from the front to the rear in the small-sized burner system 300 disposed on the center of the case 200. The mixed gas burns and moves to the rear on a glow plate 210, and is exhausted through the exhaust grill 140.

Unlike this, the mixed gas is supplied from the rear to the front of the heating cooking appliance in the two relatively large burner systems 300 disposed on both sides of the case 200. The mixed gas is secondarily mixed inside the burner system 300, and then burns on a glow plate 210, and the burning gas is exhausted to the rear of the burning system 300.

Also, a burner frame 400 is seated on the burner system 300. The burner frame 400 supports the position of the burner system 300, and provides an exhaust passage of a combustion gas generated on the glow plate 210 disposed on the burner frame. An exhaust portion allowing a combustion gas flowing along the burner frame 400 to be exhausted to an outside space, and the exhaust grill 140 disposed on the exhaust portion are provided to the rear of, the burner frame 400.

The burner frame 400 is formed in a plate shape having a predetermined thickness, and has a center portion recessed downward to provide an exhaust passage of a combustion gas on the whole.

The glow plate 210 is disposed on a portion of the upper part of the burner system 300, and heated by high heat generated when a mixed gas burns. When the glow plate 210 is heated, radiation energy of a frequency band corresponding to the physical property of the read heat plate 210 is radiated.

The radiation energy of the glow plate 210 includes at least a frequency in a visible light band, so that a user can recognize the heating cooking appliance according to an embodiment is in operation through visible light. Of course, food is heated by the glow plate 210, and the food is heated also by conduction heat of the ceramic plate 100.

Next, a structure through which a gas is supplied to the burner system 300 will be described.

A gas is supplied from the outside to the inside of the heating cooking appliance through a main supply pipe 220, and passes through a gas valve 230 controlled by the manipulation switches 160, and then is supplied to a nozzle unit (not shown) mounted on each burner system 300 through a gas supply pipe 240 branching off from the main supply pipe 220. Also, a gas supplied to the nozzle unit is sprayed to the inner space of the burner system 300.

At this point, the nozzle unit is mounted on the burner system and separated a predetermined distance from an inlet through which a gas flows.

Also, since a gas sprayed to the inner space of the burner system 300 has a high speed, low pressure is formed at a space adjacent to the inlet of the burner system 300 by Bernoulli s principle. Therefore, outside air flows into the inner space of the burner system 300 together with a gas, and the air flowing to the inner space of the burner system 300 mixes with the gas.

The mixed gas flowing to the inner space of the burner system 300 burns on the glow plate 210, and the glow plate 210 is heated by combustion heat generated when the mixed gas burns, and changes to red color to generate radiation heat.

Also, the conduction heat generated by the glow plate 210 passes through the ceramic plate 100 to heat a container containing food to cook the food.

Here, numerous fine holes are formed in the glow plate 210, a mixed gas burns while passing through the fine holes, and a combustion gas is guided by the burner frame 400 and exhausted to the outside space through the exhaust grill 140. As described above, the exhaust passage of a combustion gas formed by the burner frame 400 can be defined by a space between the lower portion of the ceramic plate 100 and the upper portion of the burner frame 400.

FIG. 4 is a perspective view of a burner system according to an embodiment, FIG. 5 is a perspective view of a lower portion of the burner system, FIG. 6 is an exploded perspective view of the burner system, FIG. 7 is a side view of the burner system, and FIG. 8 is a rear side view of the burner system.

Referring to FIGS. 4 to 8, the burner system 300 of the heating cooking appliance according to the embodiment is provided in a characteristic structure that can increase an amount of air with respect to a gas-referred to as an air ratio hereinafter—and reduce flowing resistance of the mixed gas where a gas and air mix with each other while reducing the height of the burner system 300.

Also, the burner system 300 is provided in a characteristic structure where a space to which a gas and air flow and a space where the gas and air burn form at least one common plane, and the thickness of the burner system 300 is reduced.

In detail, the burner system 300 has an outer appearance formed by a burner cover 340 and a burner base 330. Also, the burner cover 340 is coupled on the burner base 330.

A burner pot 310 providing a space where a gas and air uniformly mix with each other, and a mixing tube unit 320 for guiding gas and air flow to the burner pot 310 are integrally formed by the coupling between the burner cover 340 and the burner base 330.

An opening 345 allowing a mixed gas on the burner pot 310 to move upward is formed in the burner cover 340. Also, the diameter of the opening 345 is formed to correspond to the diameter of the burner pot 310.

The mixing tube unit 320 is disposed on the lateral side of the burner pot 310 to communicate with the latter. Here, the mixing tube unit 320 is aligned on the lateral side of the burner pot 310. Since the mixing tube unit 320 includes a plurality of mixed pipes 322 parallel to each other, an amount of air introduced together with a gas is maximized. An alignment state of the mixing tube unit 320 and the burner pot 310 is described later.

Coupling holes 332 and 342 are formed in the burner base 330 and the burner cover 340. Coupling members for vertically coupling the burner base 330 and the burner cover 340 pass through the coupling holes 332 and 342. Various coupling members can be used as the coupling members. In an embodiment, a rivet is used for example.

The coupling holes 332 and 342 through which the rivets pass include a lower coupling hole 332 formed in the burner base 330, and an upper coupling hole 342 formed in the burner cover 340.

Also, one of the coupling holes 332 and 342 has an edge bent upward or downward to allow coupling to the other. In an embodiment, the edge of the upper coupling hole 342 is bent downward, for example. In this case, when the burner cover 340 is disposed on the burner base 330, the edge of the upper coupling hole 342 is fit in the lower coupling hole 332, so that the burner cover 340 is aligned to the burner base 330.

The lower coupling hole 332 is formed in the edge of the burner base 330, and the upper coupling hole 342 is formed in a plane of the burner cover 340 contacting the burner base 330. Of course, the upper coupling hole 342 is formed in the edge of the burner cover 340.

Therefore, as the rivets pass through the coupling holes 332 and 342, the burner cover 340 and the burner base 330 are coupled to each other, so that the burner system 300 is formed.

Screw holes 334 and 344 for coupling to the burner frame 400 using coupling members are further formed in the burner base 330 and the burner cover 340. The screw holes 334 and

344 include a lower screw hole 334 formed in the burner base 330, and an upper screw hole 344 formed in the burner cover 340.

One of the upper screw hole 344 and the lower screw hole 334 has an edge bent upward or downward to form a plane to which a screw, one of coupling member passing through the screw hole, couples. In an embodiment, the edge of the lower screw hole 334 is bent downward.

When the edge of the lower screw hole 334 is bent downward, a screw passes through the bent plane, so that the burner system 300 is coupled to the lower plane of the burner frame 400.

A plurality of forming portions can be formed to reinforce strength and prevent twisting of the burner base 330 and the burner cover 340. The forming portions serve as guiding portions when the burner base 330 and the burner cover 340 couple to each other.

That is, the coupling between the burner base 330 and the burner cover 340 can be accurately performed by the coupling holes 332 and 342, and the forming portions.

Meanwhile, a member (not shown) for insulation and sealing is provided between the upper portion of the burner system 300 and the lower portion of the burner frame 400. This member may be formed of a polymer material with high thermal resistance, and may be particularly formed of a carbon fiber or a glass fiber to maintain sealing between the burner system 300 and the burner frame 400.

The burner pot 310 and the mixing tube unit 320 formed at the burner base 330 are described in detail with reference to the accompanying drawings.

The vertical height of a portion 312 where the burner port 310 and the mixing tube unit 320 are connected to each other is the same as the height of the inside of the burner pot 310.

The portion where the burner port 310 and the mixing tube unit 320 are connected to each other is substantially the same as the height of the inside of the burner pot 310 as described above, so that diffusion of a mixed gas can be improved in the inside of the burner pot 310, and the height of the burner pot 310 can be minimized.

The mixing tube unit 320 is provided in the form of a nozzle whose cross-section initially decreases as the mixing tube unit 320 approaches the burner pot 310 from an inlet of the mixing tube unit 320, and provided in the form of a diffuser whose cross-section increases after passing a minimum cross-section portion. The diffuser portion of the mixing tube unit 320 may have a cross-section that continuously increases up to a portion contacting the burner pot 310 to reduce flowing resistance of fluid flowing through the diffuser portion.

That is, a diffusion angle of the mixing tube unit 320 may be the same as a contact portion of the burner pot 310.

Also, the burner base 330 forms the lower sides of the burner pot 310 and the mixing tube unit 320. The lower side of the burner pot 310 and the lower side of the mixing tube unit 320 form a straight line.

When the burner cover 340 is coupled to the burner case 330, the burner cover 340 forms the upper side of the mixing tube unit 320.

A sealing member 314 preventing a gas and air flowing into the burner pot 310 from leaking between the upper edge of the burner pot 310 and the burner cover 340 is provided between the upper edge of the burner pot 310 and the burner cover 340. The sealing member 314 is formed in a ring shape having a predetermined thickness, and has elasticity of a predetermined degree in itself.

Also, instead of providing the burner cover 340, the burner frame 400 can be coupled to the upper sides of the burner pot 310 and the edge of the mixing tube unit 320, so that the burner frame 400 can also serve as the burner cover 340.

That is, the burner frame 400 located on the burner pot 310 forms the upper side of the mixing tube unit 320 to guide the gas and air flowing into the mixing tube unit 320 to the burner pot 310.

The mixing tube unit 320 includes a plurality of mixing tubes 322. Though three mixing tubes 322 are formed in an embodiment, there is no limitation in the number of mixing tubes.

Also, the mixing tubes 322 extend in the same direction. In other words, the extension lines of the mixing tubes 322 may be formed not to cross one another. When the extension lines are formed as described above, turbulence generation of a gas and air from different mixing tubes 322 increases in the inside of the burner pot 310. When the turbulence generation increases, mixing of the gas and air increases, so that the combustion efficiency of the gas increases.

When the burner base 330 and the burner cover 340 are coupled to each other, a nozzle seat portion 370 on which a nozzle unit is seated is formed in the rear of the mixing tube unit 320. The nozzle seat portion 370 is separated a predetermined distance from the mixing tube unit 320.

The nozzle seat portion 370 is bent downward from the ends of the burner base 330 and the burner cover 340, and then extends further in a lengthwise direction. The nozzle seat portion 370 is formed in a quadrangular plate shape having a predetermined thickness on the whole.

A part 371 of the nozzle seat portion 370 where the nozzle unit is seated is recessed downward with a predetermined curvature. When the nozzle unit is seated on the part recessed downward, a spray center of the nozzle unit and an inlet center of the mixing tube unit 320 are disposed on a straight line of substantially the same height.

That is, since the spray center of the nozzle unit changes depending on the recessed depth of the nozzle seat portion 370, the recessed depth of the nozzle seat portion 370 is set such that an inlet center of the mixing tube unit 320 and the spray center of the nozzle unit are located on a straight line at substantially the same height when the nozzle unit is seated. Therefore, when the nozzle unit is seated by an operator, the spray center and the inlet center of the mixing tube unit 320 are located on a straight line at substantially the same height.

Here, the nozzle seat portion 370 is bent downward at the end of the burner base 330, bent downward at the end of the burner cover 340. Also, the ends of the burner base 330 and the burner cover 340 can be bent downward together and coupled to form the nozzle seat portion 370.

In an embodiment, the burner base 330 and the burner cover 340 are bent downward together to form the nozzle seat portion 370.

A fixing hole 372 to which a fixing member for fixing the nozzle unit is coupled is formed in the nozzle seat portion 370 with the nozzle unit seated on the part 371 recessed downward with a predetermined depth.

A method for manufacturing a burner system will be described below.

The burner system 300 is formed by an operation of cutting a raw material and pressurizing the cut raw material to form the burner base 330 and the burner cover 340, and an operation of vertically coupling the burner base 330 and the burner cover 340 formed in the previous operation.

During the operation of forming the burner base 330 and the burner cover 340, the appearances of the burner pot 310, the mixing tube unit 320, and the nozzle seat portion 370 are formed.

FIG. 9 is a plan view illustrating an inlet path and an outlet path of fluid generated from the inside of a heating cooking appliance according to an embodiment.

Referring to FIG. 9, according to the burner systems disposed on both sides in the inner space of the case 200, fluid, i.e., a gas and air are introduced to the front from the rear, and then the gas and air mix secondarily with each other sufficiently inside the burner pot 310. Also, a mixed gas where the gas and air have mixed sufficiently burns while passing through the glow plate 210 and flowing upward. The combustion gas is exhausted to the rear.

According to the above-described burner system, turbulence is sufficiently generated due to collision between mixed gases inside the burner pot 310, so that a movement velocity of the mixed gas initially moving to the front disappears, and the gas and air uniformly mix inside the burner pot 310 on the whole.

Furthermore, when a mixed gas moves upward through the glow plate 210, the gas burns on the glow plate 210, and the generated combustion gas moves swiftly.

Therefore, in the burner system disposed on both sides inside the heating cooking appliance according to an embodiment, fluid can swiftly move without flowing resistance even when an inlet side and an outlet side of the fluid are totally different from each other.

According to an embodiment, since the burner system is completed through coupling between the burner case and the burner cover, the height and the thickness of the burner system are reduced. Also, because the thickness of the burner system is reduced, a wide combustion space can be secured, so that heating capacity increases.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. A burner system of a heating cooking appliance, the burner system comprising:

a burner pot for providing a space where a gas and air mix and burn;

a mixing tube unit integrally formed with the burner pot to guide the gas and the air to the burner pot; and a glow plate configured to generate radiation energy by burning mixed gas and disposed on the burner port, wherein the burner pot and the mixing tube unit having an appearance formed by a plurality of members coupled vertically, the plurality of members comprise a burner cover forming an upper side of the mixing tube unit, and a burner base forming lower sides of the burner pot and the mixing tube unit, wherein an opening having a diameter corresponding to that of the burner pot is formed in the burner cover for supplying gas mixed with air to the glow plate, and wherein the mixing tube unit comprises a plurality of mixing tubes parallel to one another.

2. The burner system according to claim 1, wherein a nozzle seat portion on which a nozzle unit is seated is integrally formed on one spaced side of the mixing tube unit, the nozzle unit sprays the gas to the mixing tube unit.

3. The burner system according to claim 1, wherein the mixing tube unit is located on a side of the burner pot.

4. The burner system according to claim 1, wherein coupling holes to which coupling members are coupled are formed in the burner cover and the burner base, respectively.

5. The burner system according to claim 4, wherein the coupling members comprise rivets.

6. The burner system according to claim 4, wherein an edge of one of the coupling holes is inserted into the other coupling hole.

7. The burner system according to claim 1, wherein a nozzle seat portion is formed on at least one of the burner cover and the burner base, a nozzle unit for spraying the gas to the mixing tube unit being seated on the nozzle seat portion.

8. The burner system according to claim 1, wherein a plurality of forming portions for guiding vertical coupling are formed in the burner cover and the burner base.

9. The burner system according to claim 1, wherein a sealing member for sealing is provided between the burner cover and the burner base.

10. A heating cooking appliance comprising:

a case;

a plate for covering an upper side of the case;

a burner system provided inside the case: and a burner frame provided above the burner system to forman exhaust passage for a combustion gas generated from the burner system, the burner system comprising:

a burner base for providing both a partial surface of a burner pot providing a space where a gas and air uniformly mix, and a partial surface of a mixing tube unit for guiding flowing of the gas and air to the burner pot;

a burner cover coupled to the burner base to provide other partial surface of the mixing tube unit; and a glow plate configured to generate radiation energy by burning mixed gas and disposed on the burner cover, wherein the radiation energy passes through the plate to heat the food loaded on the plate, wherein an opening having a diameter corresponding to that of the burner pot is formed in the burner cover for supplying gas mixed with air to the glow plate, and wherein the mixing tube unit comprises a plurality of mixing tubes parallel to one another.

11. The heating cooking appliance according to claim 10, wherein the burner base provides lower sides of the burner pot and the mixing tube unit, and the burner cover provides an upper side of the mixing tube unit.

12. The heating cooking appliance according to claim 10, wherein the mixing tube unit is located on a side of the burner pot.

13. The heating cooking appliance according to claim 10, wherein a nozzle seat portion is formed on at least one of the burner cover and the burner base, a nozzle unit for spraying the gas to the mixing tube unit being seated on the nozzle seat portion.

14. The heating cooking appliance according to claim 13, wherein the nozzle seat portion is spaced apart from the mixing tube unit.

15. The heating cooking appliance according to claim 10, wherein coupling holes through which coupling members pass are formed in the burner base and the burner cover, respectively.

16. The heating cooking appliance according to claim 10, wherein screw holes allowing the burner system to couple to the burner frame are formed in the burner base and the burner cover, respectively.

17. The heating cooking appliance according to claim 16. wherein a coupling plane to which a coupling member couples extends from at least one of the screw holes.

18. The heating cooking appliance according to claim 10, further comprising a sealing member between the burner cover and the burner base.

* * * * *